US005967856A

United States Patent [19]

Meller

[11] Patent Number: 5,967,856

[45] Date of Patent: Oct. 19, 1999

[54] CONNECTOR WITH SPRING CONTACT MEMBER AND SHORTING MEANS

[75] Inventor: Andrew G. Meller, Vlijmen, Netherlands

[73] Assignee: Berg Technology, Inc., Reno, Nev.

[21] Appl. No.: 08/836,343

[22] PCT Filed: Dec. 20, 1995

[86] PCT No.: PCT/US95/16825

§ 371 Date: May 5, 1997

§ 102(e) Date: May 5, 1997

[87] PCT Pub. No.: WO96/19854

PCT Pub. Date: Jun. 27, 1996

[51] Int. Cl.[6] ..... H01R 13/24

[52] U.S. Cl. ..... 439/700

[58] Field of Search ..... 439/513, 482, 439/289, 700, 824, 66, 357, 919, 929

[56] References Cited

U.S. PATENT DOCUMENTS

| | | | |
|---|---|---|---|
| 2,922,948 | 1/1960 | Washburn | 324/437 |
| 3,903,385 | 9/1975 | Moyer et al. | 200/51.1 |
| 4,070,557 | 1/1978 | Ostapovitch | 200/51.1 |
| 4,161,346 | 7/1979 | Cherian et al. | 439/66 |
| 4,199,209 | 4/1980 | Cherian et al. | 439/591 |
| 4,307,928 | 12/1981 | Petlock, Jr. | 439/824 |
| 4,358,173 | 11/1982 | Conrad | 439/71 |
| 4,359,252 | 11/1982 | Olsson et al. | 439/71 |
| 4,533,203 | 8/1985 | Feldman et al. | 439/64 |
| 4,634,199 | 1/1987 | Anhalt et al. | 439/69 |
| 4,647,126 | 3/1987 | Sobota, Jr. | 439/74 |
| 4,708,659 | 11/1987 | Wozniczka | 439/62 |
| 4,734,051 | 3/1988 | Burns | 439/289 |
| 4,752,251 | 6/1988 | Kato et al. | 439/752 |
| 4,773,877 | 9/1988 | Kruger et al. | 439/482 |
| 4,778,404 | 10/1988 | Pass | 439/387 |
| 4,978,311 | 12/1990 | Oda et al. | 439/188 |
| 5,052,943 | 10/1991 | Davis | 439/357 |
| 5,090,117 | 2/1992 | Dickie | 29/840 |
| 5,167,512 | 12/1992 | Walkup | 439/66 |
| 5,358,411 | 10/1994 | Mroczkowski et al. | 439/66 |
| 5,807,123 | 9/1998 | Splegelaar et al. | 439/188 |

FOREIGN PATENT DOCUMENTS

| | | |
|---|---|---|
| 0718 918 A1 | 5/1995 | European Pat. Off. . |
| 3507 464 A1 | 3/1985 | Germany . |
| 695 00 525 T2 | 5/1995 | Germany . |
| 2 234 403 | 1/1991 | United Kingdom . |

*Primary Examiner*—Steven L. Stephan
*Assistant Examiner*—Barry Standig
*Attorney, Agent, or Firm*—Daniel J. Long; M. Richard Page

[57] ABSTRACT

Connector block (3) comprising at least one contact member (22) provided with a first contact terminal (10) for electrical contact to a contact terminal (60) of a mating connector (2), a second contact terminal (9) and a spring subdivision (13) giving the contact member a resilient capacity in its axial direction, the first contact terminal (10), the second contact terminal (9) and the spring subdivision (13) being integrally made and the spring subdivision (13) having a corrugated compression spring with equally spaced sinusoidal subdivisions, each of the first contact terminals (10) being provided with bent extremity (16).

11 Claims, 12 Drawing Sheets

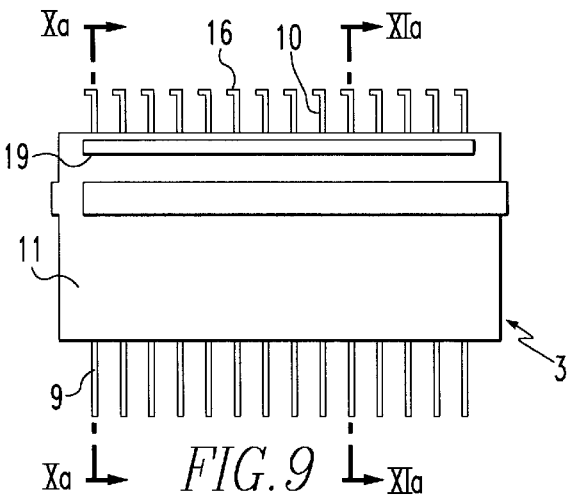
FIG. 9
FIG. 10b
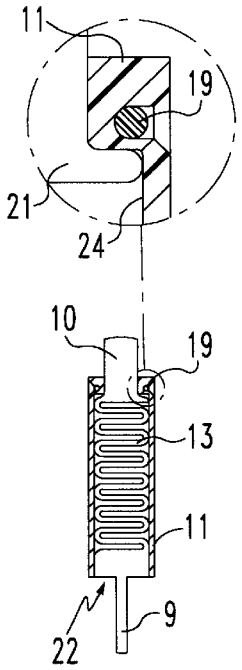
FIG. 10a
FIG. 11b
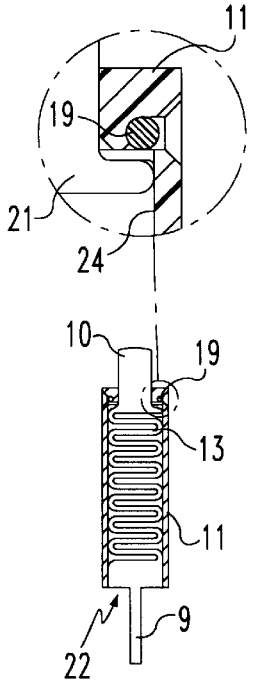
FIG. 11a
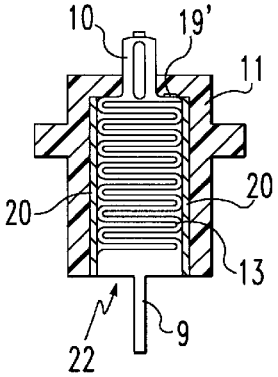
FIG. 12a
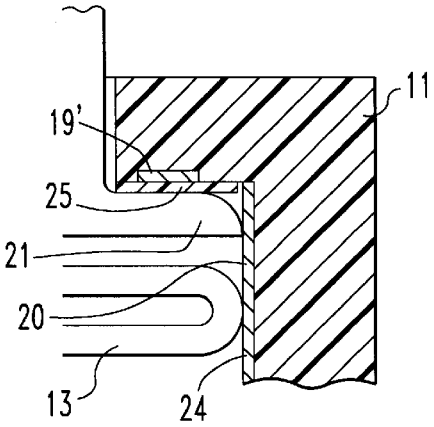
FIG. 12c
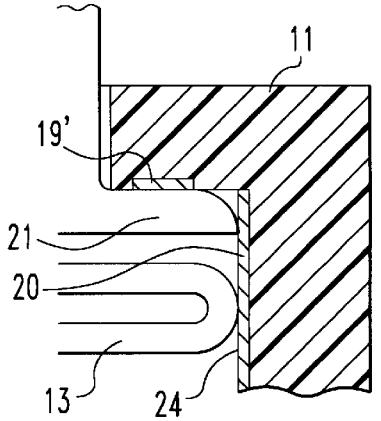
FIG. 12b

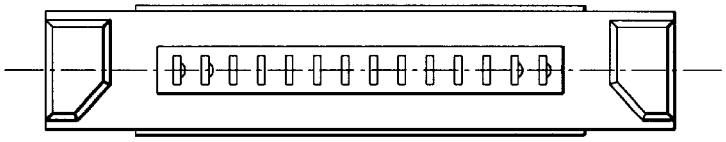
FIG. 19b
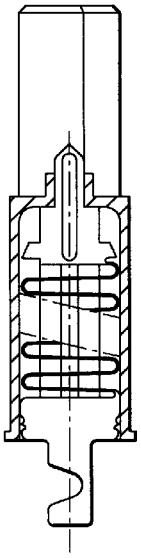
FIG. 19c
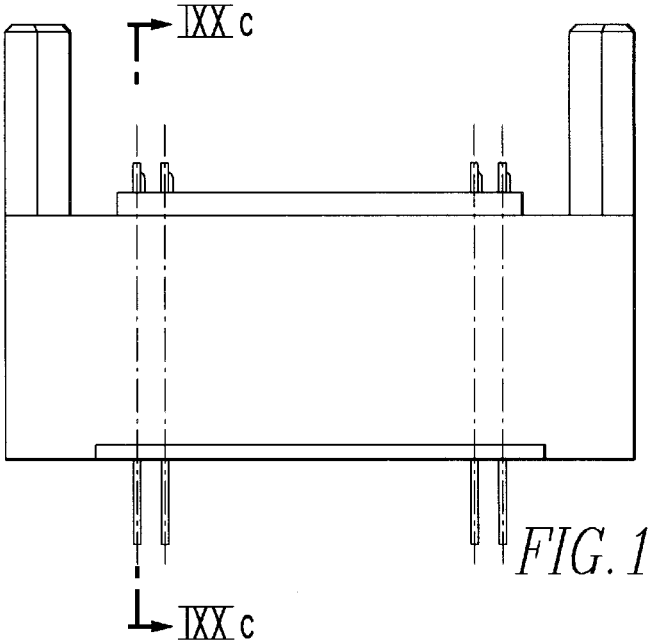
FIG. 19a
FIG. 19e
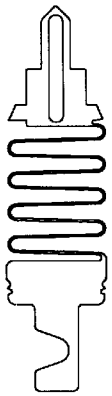
FIG. 19d
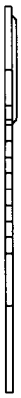
FIG. 19f

CONNECTOR WITH SPRING CONTACT MEMBER AND SHORTING MEANS

BACKGROUND OF THE INVENTION

The present invention relates to a connector block comprising at least one contact member in at least one cavity, each contact member being integrally made and provided with a first contact terminal for electrical contact to a contact member of a mating electric element, a second contact terminal and a corrugated spring part giving the contact member a resilient capacity in a predetermined axial direction and being provided with at least a substantially flat middle section.

Such a connector block is known from U.S. Pat. No. 4,773,877, which discloses a connector for an electronic tester for testing an electronic device such as a printed circuit board. The known connector is provided with one or several resilient contact pins, each of said pins having a plunger member and a spring, which plunger member and which spring of each of the contact pins are jointly formed in one piece from a portion of metal sheet. In some of the embodiments shown, the spring has at least a substantially flat middle section. However, parts of the spring may be folded about folding lines. The spring may have an undulating or meander pattern or a zig-zag-shape. More details regarding this prior art connector block will be given below when FIG. 3 is explained. However, the known spring contact member is provided with a sharp contact point which makes the known connector unsuitable for many connecting and disconnecting operations: the sharp contact point would destroy the contact terminal of a mating connector within a very short time period.

EP-A-0,009,314 discloses an electrical connector suitable for micro-circuit technology. The connector comprises several connecting elements disposed in rows and columns. Each of the connecting elements is stamped and formed in one piece from sheet metal in strip form. Two identical sinuous portions extend from a strap, the end portions of which function as contact terminals for contacting conductors on e.g. printed circuit boards. The sinuous portions render the contact element resilient in an axial direction. Upper and lower spring sections extend from the strap portion. During operation, the entire connecting element is inserted in a corresponding cavity in the connector body in such a way that contact dimples, provided on the contact terminals are electrically contacting the upper and lower spring sections. The spring sections provide a shorter electrical path than that of the sinuous spring portions. However, both the sinuous spring portions and the spring sections for providing a short circuit are bent relative to the strap portion. Moreover, the end portions of the sinuous portion are bent to form a U-shape. Thus, these known contact members need many bending steps during manufacturing and are difficult to be made.

SUMMARY OF THE INVENTION

Therefore, it is an object of the present invention to provide a connector with at least one spring contact member which allows further miniaturization of the connector and which can be easily and relatively cheaply manufactured.

This objective is obtained by a connector block defined at the outset and characterized in that the first contact terminal of said at least one contact member is provided with a bent extremity.

Such a bent extremity establishes a less sharp contact member and enhances the possible number of connecting and disconnecting operations between the connector block and a mating connector.

Preferably, each of the extremities is provided with a dimple to further reduce the sharpness of the contacting end of the first contact terminal.

Preferably, each of the extremities is bent relative to the axial direction through about $\pi/2$ radians.

The first contact terminal of said at least one contact terminal may be provided with a rib arranged in the axial direction of the first contact terminal.

Preferably, each of the spring parts extend in a substantially flat surface and are provided with U-shaped or V-shaped interconnected parts.

The interconnected parts may be provided with legs and base parts interconnecting the legs, the width (x) of the legs differing from the width (y) from the base parts.

In one embodiment, the connector block comprises a plurality of said contact members arranged along a line and said flat surfaces are inclined relative to said line.

In another embodiment, each of the spring parts are provided with U-shaped or V-shaped interconnected parts provided with legs and base parts interconnecting the legs, at least some of the spring parts being folded in such a way that they show a substantially C-shaped or U-shaped cross section seen in the axial direction of the contact members.

In a further embodiment, each of the spring parts are provided with U-shaped or V-shaped interconnected parts provided with legs and base parts interconnecting the legs, at least one pair of adjacent spring parts being folded in such a way that they show substantially C-shaped cross sections seen in the axial direction of the contact members, the C-shaped cross sections being interlaced. Interlacing such C-shaped cross sections supports the objective of reducing the size of the connector.

Preferably, each of the cavities are provided with a by-pass strip for reducing the electrical resistance between the first terminal and the second terminal of each of the contact members.

Each of such by-pass strips may comprise a metal layer on the inside surface of the respective cavity. Such a metal layer may be made very thin which further supports the objective of miniaturization.

Preferably, the spring part is provided with a part close to the first terminal and is designed in such a way that said part is resiliently forced against the by-pass strip.

BRIEF DESCRIPTION OF THE DRAWINGS

The present invention will be further illustrated by reference to some drawings showing embodiments of the present invention. The embodiments are only meant to illustrate the present invention and not to limit its scope. In the drawings:

FIG. 9 shows a connector with several spring contact members and one ground conductor to establish a static discharge possibility to ground;

FIG. 10*a* shows a cross section along line X—X in FIG. 9;

FIG. 10*b* shows an enlarged view of a detail of FIG. 10*a;*

FIG. 11 a shows a cross section view along line XI—XI in FIG. 9;

FIG. 11*b* shows an enlarged view of a detail of FIG. 11*a;*

FIG. 12 shows a cross section of an alternative embodiment of the connector with a spring contact member according to the invention;

FIG. 12*b* shows a detail of the connector according to FIG. 12*a;*

FIG. 12*c* shows a detail of a cross section through another cavity of the connector according to the embodiment of FIG. 12*a;*

FIGS. 19*a*, 19*b*, 19*c* and 19*d* are respectively a front elevational view of another embodiment of the contact, a top plan view of the contact a cross-section through A—A in FIG. 19*a* and a detailed view of the contact;

DETAILED DESCRIPTION OF THE PREFERRED EMBODIMENTS

Figure 1:
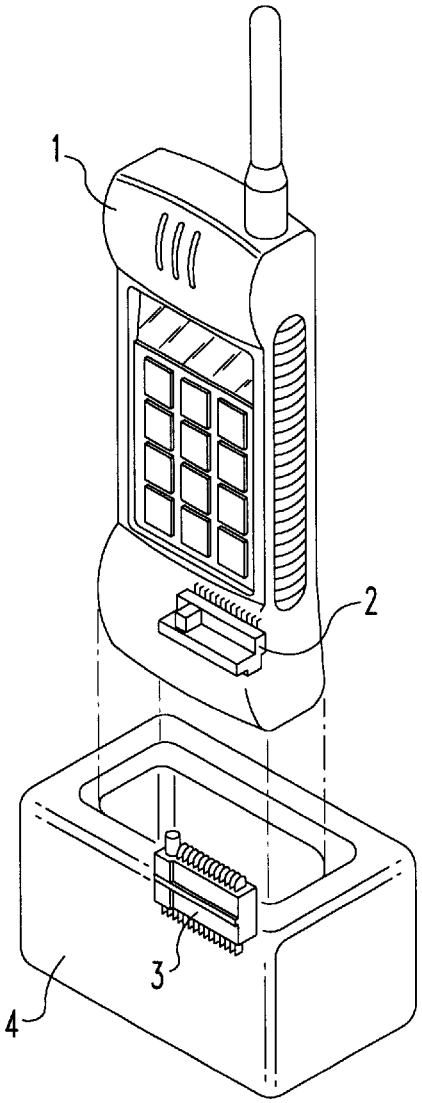
FIG. 1 shows schematically, a hand-held telephone set according to the prior art.

FIG. 1 shows schematically, a hand-held telephone set known per se and comprising a telephone cradle 1 and a separate housing 4. The separate housing 4 may have any convenient shape, e.g. a large U-shape able to entirely accommodate the telephone cradle. The housing 4 may be fixed to a wall, a dash board of a car, etc. The housing 4 is made of any suitable material, e.g. plastic. The telephone cradle 1 can be connected to or disconnected from the housing 4. To this end, the telephone cradle 1 is provided with a cradle connector 2 and the housing 4 with a connector block 3. Such a hand-held telephone set must meet very demanding requirements. First of all, the force necessary to connect the telephone cradle to the housing 4 must be as low as possible. Secondly, the electrical connection between the cradle connector 2 and the connector block 3 must be very reliable, even after very many connections and disconnections. The cradle connector 2 and the connector block 3 must be designed for as many connecting and disconnecting operations as at least ten thousand. Thirdly, the cradle connector 2 and the connector block 3 must be designed as small as possible. Such connectors need to accommodate fifteen or more electrical connections. However, the overall dimensions of the telephone cradle 1 are largely dependent on the dimensions of the cradle connector 2 and the connector block 3. Especially, the pitch distance between neighboring contact members in the cradle connector 2 and the connector block 3 must be as small as possible. Moreover, the thickness and the width of the cradle connector 2 and the connector block 3 have to be as small as possible. Fourthly, any operator of the telephone cradle 1 must be allowed to connect the telephone cradle 1 to the housing 4 from a beveled position, i.e. from a position in which the length direction of the telephone cradle 1 does not coincide with the axial direction of the contact members of the connector block 3.

Figure 2A:
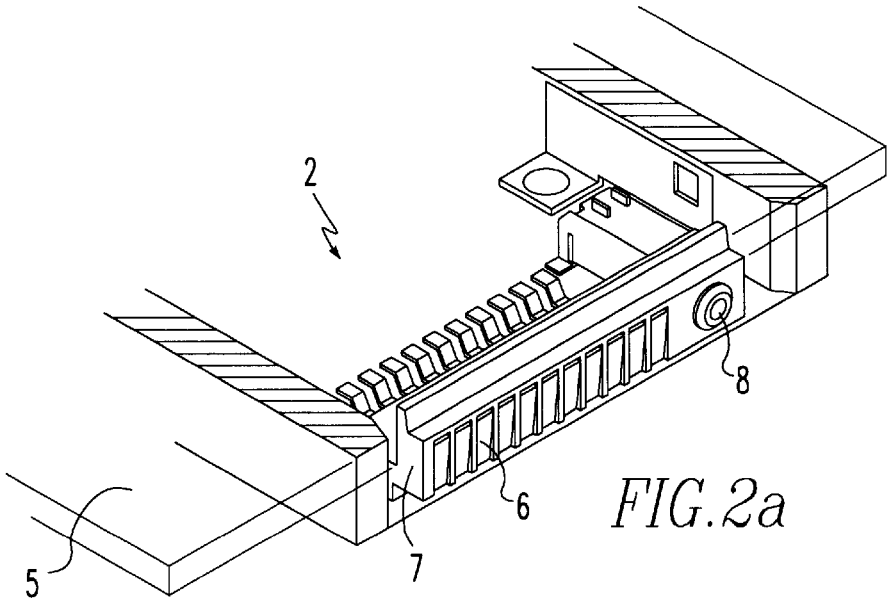
FIG. 2*a* and 2*b* show connectors used in the prior art arrangement according to FIG. 1.
Figure 2B:
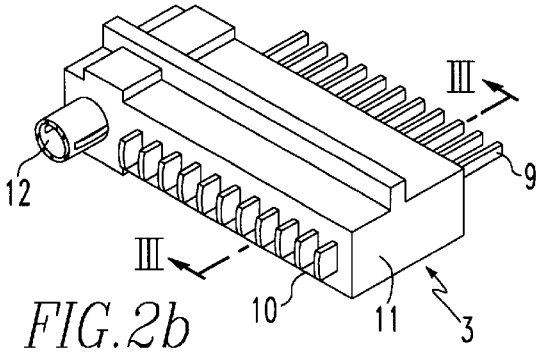

Because of the fourth requirement mentioned above the cradle connector 2 cannot simply be provided with female type terminals to receive male type contact terminals 10 (FIG. 2*b*) of the connector block 3. The contact terminals 6 of the cradle connector 2 have to be designed in such a way that in the connecting state between the cradle connector 2 and the connector block 3 a sliding contact is provided between the respective contact terminals 6 (FIG. 2*a* and the contact terminals 10 )(FIG. 2*b*). Therefore, the contact terminals 6 of the cradle connector 2 are usually provided with flat extremities, as shown in FIG. 2*a*.

The cradle connector 2 and the connector block 3 may be provided with at least one switch coax line for guiding signals which have to be shielded from the outside world.

However, when the option of a sliding contact between the contact terminals 6 and the contact terminals 10 is chosen, each of the contact members of the connector block 3 have to be provided with a spring action in the axial direction of each contact member.

Figure 3:
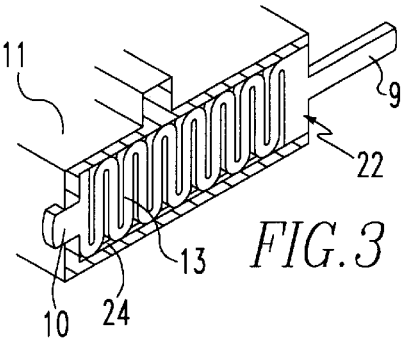
FIG. 3 shows a cross section through a connector block provided with a corrugated spring contact member largely known as such.

FIG. 3 shows a cross section through a connector block is essentially known from U.S. Pat. No. 4,773,877 albeit for purposes of testing electronic components. The contact member 22 is accommodated within a cavity 24 within the insulating housing 11. The contact member 22 is an integral member comprising a contact terminal 10 for electrical contact to a mating contact terminal 6 (FIG. 2*a*), a contact pin 9 to be fixed to a printed circuit board in a manner known to any person skilled in the art and a corrugated spring part 13. The contact member shown in FIG. 3 is substantially flat and may, advantageously, be made by stamping from a sheet of thin metal, e.g. made of phosphor bronze.

Figure 4:
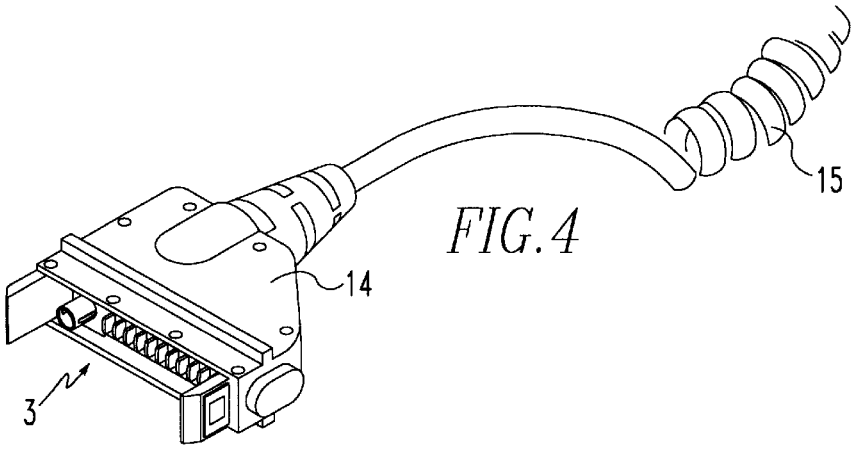
FIG. 4 shows a connector block according to FIG. 3 accommodated within a connector housing connected to a conventional cable.

The connector block 3 may be arranged in a housing as shown in FIG. 1. However, the connector block 3 shown in FIG. 3 may also be accommodated within the housing 14 of a connector connected to a cable 15, as shown in FIG. 4.

There is no restriction as to the location where the connector block 3 of FIG. 3 may be arranged. Moreover, there is no restriction as to the number of spring contact members 22 within the housing 11 of the connector block 3, or their arrangement within the connector block 3. Like the prior art connector block 3, shown in FIG. 2B, the connector block 3 according to the invention may be provided with one or more switch coax lines 12 or any other kind of contact members.

Figure 5A:
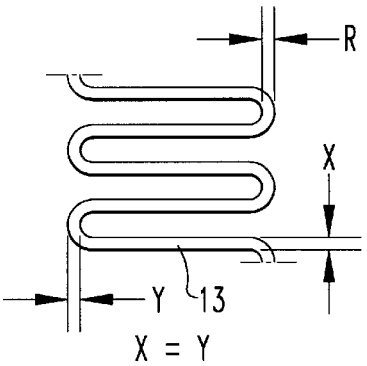
FIGS. 5*a*, 5*b*, 5*c* show different embodiments of the spring part of the spring contact member.

FIG. 5*a* shows a side view of several legs of a corrugated spring part 13 of a spring contact member 22. The corrugated spring part 13 comprises several adjacent U-shapes, adjacent U-shapes being oppositely arranged. In FIG. 5*a* R designates a radius of each U-shape base. References sign X designates the width of each of the legs, whereas reference sign Y designates the width of each of the bases. In the arrangement according to FIG. 5*a* the following relation holds: Y=X.

Figure 5B:
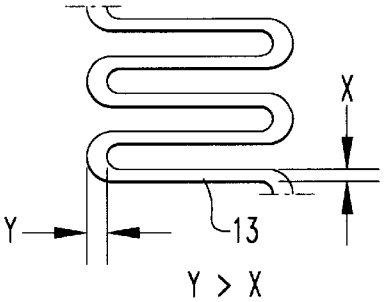
Figure 5C:
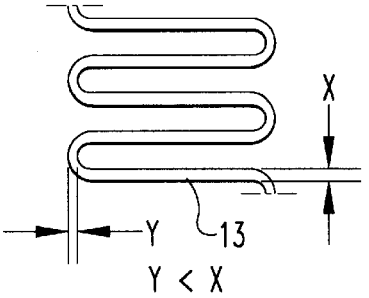

FIG. 5*b* and 5*c* show alternative embodiments of the corrugated spring part 13 of a spring contact member 22. Reference signs X and Y designate the same dimensions as in FIG. 5*a*. In the embodiment shown in FIG. 5*b* the relation Y>j X holds, whereas in the embodiment shown in FIG. 5*c* the relation Y<X holds.

Figure 6:
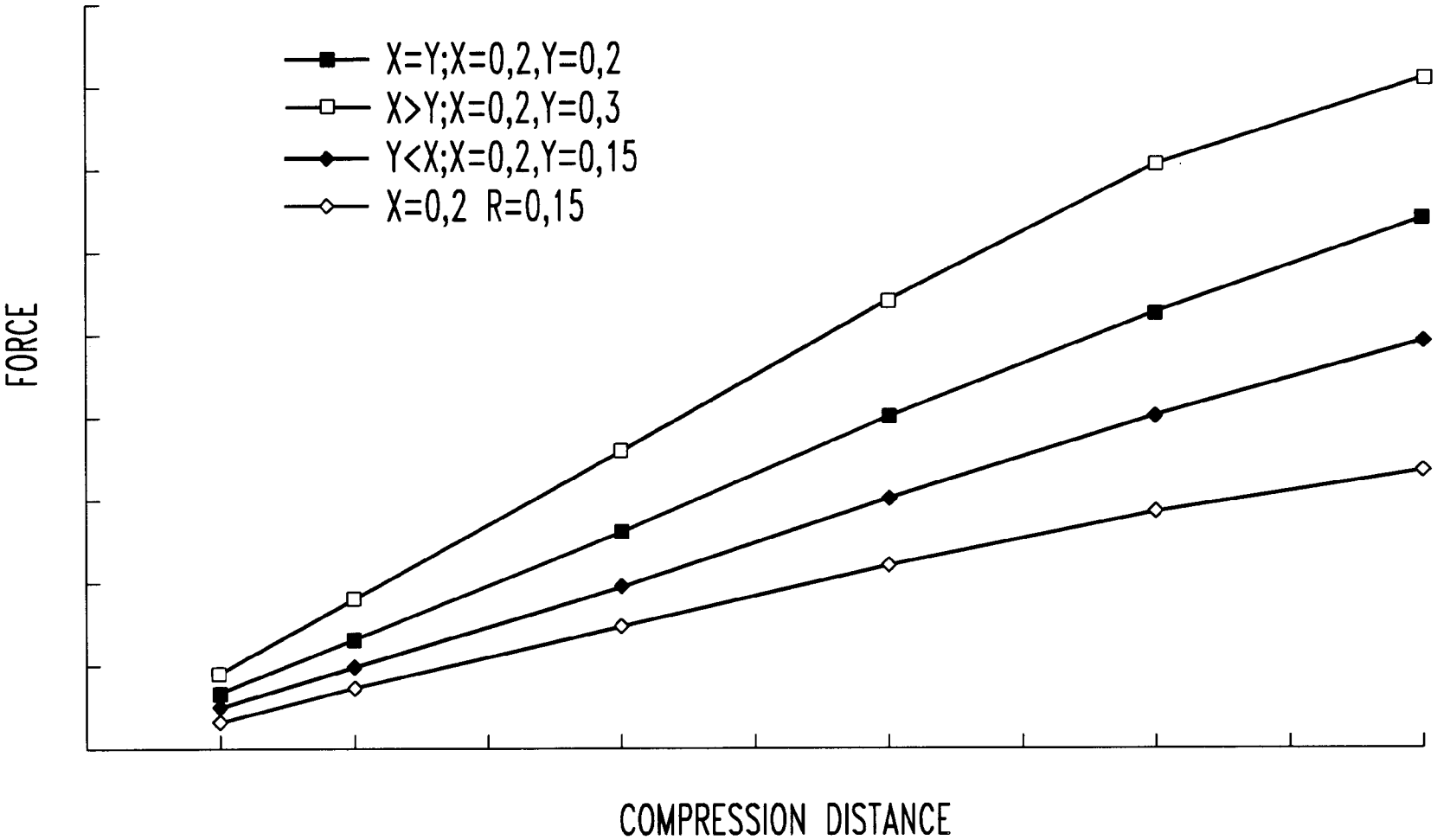
FIG. 6 shows a functional relationship between the force necessary to compress the spring contact member in its axial direction and the compression distance.

By varying the radius R and the width X of the legs, and the width Y of the base the force necessary to compress the spring contact member 22 may be varied. FIG. 6 shows a functional relationship between said force and the compression distance for some selected dimensions of X, Y, and R. The dimensions given are in millimeters. Of course, the relationship shown in FIG. 6 also depends on the material from which the spring contact member 22 is made. Preferably, the force necessary to compress the spring contact member 22 is constant, and independent of the compression distance. However, in practice this is not possible. The dimensions of X, Y, and R are preferably chosen in such a way that the force necessary to compress the spring contact member 22 is between 0.2 and 0.4 Newton.

Figure 7A:
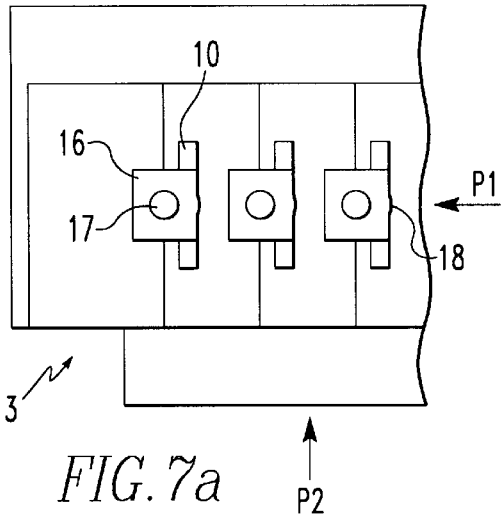
FIG. 7*a* shows a top view of one embodiment of the spring contact member according to the invention.
Figure 7B:
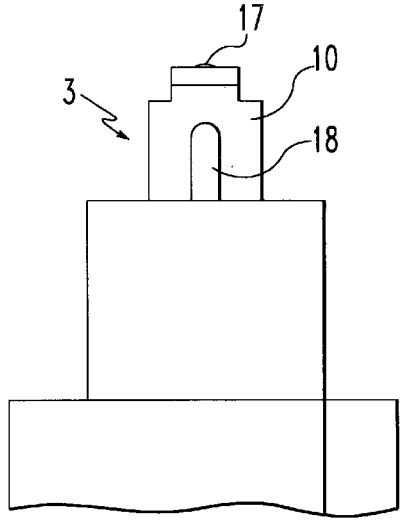
FIG. 7*b* shows a side view of the spring contact member according to FIG. 7*a;*
Figure 7C:
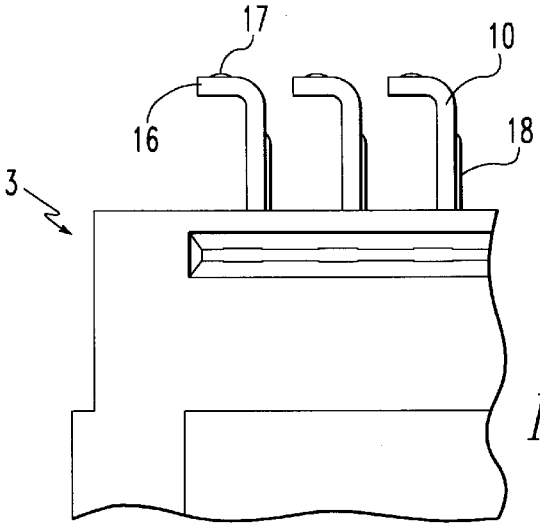
FIG. 7*c* shows a side view of the spring contact member according to FIG. 7*a* but perpendicular to the side view of FIG. 7*b;*

FIG. 7*a* shows a further embodiment of a connector block 3. FIG. 7*a* shows a top view, whereas FIG. 7*b* shows a side view in the direction of arrow P1 in FIG. 7*a* and FIG. 7*c* shows another side view in the direction of arrow P2 in FIG. 7*a*. Arrows P1 and P2 are perpendicular to each other. In the embodiment of FIGS. 7*a*, 7*b*, and 7*c* each of the contact terminals 10 is provided with a bent extremity 16 in order to establish a less sharp contact member 10 and to enhance the possible number of connecting and disconnecting operations between the connector block 3 and the mating cradle connector 2 (FIG. 2*a*). Preferably, each extremity 16 is bent through substantially π/2 radians relative to the axial direction of contact members 22. Preferably each of the bent extremities 16 is provided with a dimple 17 to further enhance the possible number of connecting and disconnecting operations. This dimple 17 may occupy a relatively large part of the bent extremity 16 to ensure a smooth and reliable contact with a contact member 6 of a mating connector 2 under many different angles of contacting that mating connector 2.

Also shown in FIGS. 7*a*, 7*b*, and 7*c* is a rib 18 arranged in the axial direction of each contact terminal 10 in order to enforce the rigidity of each of the contact terminals 10.

Figure 8A:
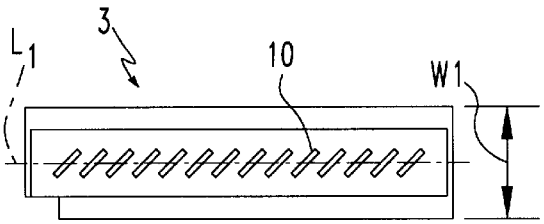
FIG. 8*a* and FIG. 8*b* show, schematically, different possible orientations of the spring contact member 22 relative to the housing of the connector block.
Figure 8B:
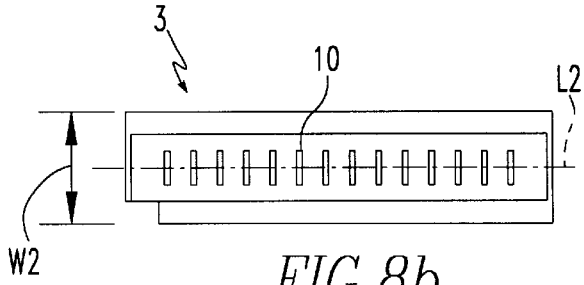

FIGS. 8*a* and 8*b* show two different possible orientations of the spring connector members 22. Both FIGS. 8*a* and 8*b* show schematically top views of a connector block 3 having contact terminals arranged along one line L1. In the embodiment showing in FIG. 8*a*, the spring contact members 22 have an angle of inclination relative to line L1 smaller than π/2, whereas in the embodiment shown in FIG. 8*b* the angle of inclination between the spring contact members 22 and line L1 is substantially Pi/2. The advantage of the embodiment according to FIG. 8*a* is that the width W1 of the connector block 3 may be smaller than the width W2 of the connector block 3 in the embodiment according to FIG. 8*b*.

FIG. 9 schematically shows a connector block 3 which is provided with a ground conductor 19. The ground conductor 19 is, during operation, connected to ground, e.g. through a contact pin connected to a ground layer on a printed circuit board to which the connector block 3 is connected. The purpose of the ground conductor 19 is to provide a static discharge capability for selected contact members 22, e.g. those contact members 22 which are connected to (C)MOS circuit parts on a printed circuit board.

FIG. 10*a* shows a cross section through the connector block 3 according to FIG. 9 along line X—X, whereas FIG. 11 a shows a cross section through the connector block 3 according to FIG. 9 along line XI—XI. FIG. 10*b* shows an enlarged view of the ground conductor 19 from the cross section of FIG. 10*a*, whereas FIG. 11*b* shows an enlarged view of the ground conductor 19 from the cross section of FIG. 11*a*.

FIGS. 10*a* and 10*b* show that each of the contact members 22 may be provided with an extension 21 at the extremity part of the corrugated spring part 13 adjacent to the ground conductor 19. In the disconnected state of the connector block 3 the extension 21 is forced to the extremity of the cavity within the insulating housing 11 of the connector block by the spring action of the corrugated spring part 13. The extension 21 shown in FIGS. 10*a* and 10*b* is insulated from the ground conductor 19 by a wall part of the insulating housing 11. Consequently, there is no electrical contact between the extension 21 and the ground conductor 19 and no static discharge capability is provided for.

However, the extension 21 of the contact member 22 shown in FIG. 11*a* and 11*b* electrically contacts the ground conductor 19 when the connector block 3 is not connected to a cradle connector 2 and the extension 21 is forced to the extremity of the cavity within the housing 11. No insulating wall is present between the ground conductor 19 and the extension 21 in FIGS. 11*a* and 11*b*. Therefore, any static charge on the contact member 2 in FIGS. 11*a* and 11*b* will be conducted to ground through the ground conductor 19 when the connector block 3 is disconnected. Static charges on the contact member 22 of FIGS. 11*a* and 11*b* are not able to damage (C)MOS circuit parts on a printed circuit board connected to contact pin 9.

The ground conductor 19 in the embodiment shown in FIGS. 9, 10*a*, 10*b*, 11*a*, and 11*b* is made of a small rod from any suitable metal. e.g. phosphor bronze. However, it is also possible to provide a ground conductor strip 19' instead of a rod 19: FIGS. 12*a*, 12*b* and 12*c*. The ground conductor strip 19' may be applied to the inside wall of the insulating housing 11 of the connector block 3 by means of a method for selectively metallization of plastic connectors as described and claimed in European patent application 94202140.3. The ground conductor strip 19; is connected to ground, e.g. on a printed circuit board to which the connector block 3 is fixed, by suitable conductor means (not shown).

FIG. 12*b* shows a cross section through a cavity 24 in which the ground conductor strip 19' is exposed to electrically contact part 21 of spring part 13 when the connector block 3 is in its disconnected state. FIG. 12*c* shows a cross section through a cavity 24 in which the ground conductor strip 19' is covered by an insulating layer 25 to prevent electrical contact between the strip 19' and the part 21 of the spring part 13 in this cavity 24.

FIGS. 12*a* and 12*b*, the latter showing an enlarged view of a construction detail of FIG. 12*a*, also show by-pass strips 20 provided on the inside wall of the cavity in which the contact member 22 is accommodated. As is clearly shown in FIG. 12*b* the ground conductor strip 19' and the by-pass strip 20 are separate from each other and do not contact each other directly. The purpose of the by-pass strip 20 is to electrically contact as many U-shaped bases of the spring contact member 22 as possible and therefore to provide a short circuit for any electrical current through the contact member 22. The application of by-pass strip 20 reduces the electrical resistance between the contact terminal 10 and the contact pin 9 from each of the spring contact members 22. A by-pass strip 20 may be provided at both sides of each of the contact members 22, as shown in FIG. 12*a*. However, one by-pass strip 20 may be provided instead. The by-pass strips 20 may be applied on the inside walls of the cavity by the method for selective metallization of plastic connectors described in European patent application 94202140.3, referred to above. However, any other method for selective metallization may be used. Alternatively, a metal sleeve may be used, surrounding the spring contact member 22.

In order to ensure the best operation of the by-pass strip 20 the corrugated structure of the spring part 13 is, preferably, designed in such a way that the extension 21 is resiliently forced against the by-pass strip 20. Then, as little current as possible is flowing through the spring part 13 itself. The surface part of extension 21 contacting the by-pass strip 20 is preferably rounded and free of any burr. Alternatively, the first parts of the corrugated structure opposite to extension 21 may be resiliently forced against by-pass strip 20.

The provision of a ground conductor 19 or a ground conductor strip 19; according to any of the FIGS. 9 through 12*b* is also applicable to any other kind of spring contact member, e.g. the ball pen-type of spring members from the prior art described in the introduction. Of course, when the conductor block 3 provided with either a ground conductor 19 or a ground conductor strip 191 is connected to a mating cradle connector 2 those spring contact members 22 which electrically contact either the ground conductor 19 or the ground conductor strip 19' in the disconnected state will have to be at least slightly compressed in the connected state in order to avoid an electrical connection between the ground conductor 19 or the ground conductor strip 19' and the extension 21 during operation. In order to have such a guaranteed compression during operation those spring contact members 22 which have such static discharge capability may extend slightly more from the body of the connector block 3 with their contact terminals 10 than do the other spring contact members 22 which do not have such a static discharge capability.

Figure 13C:
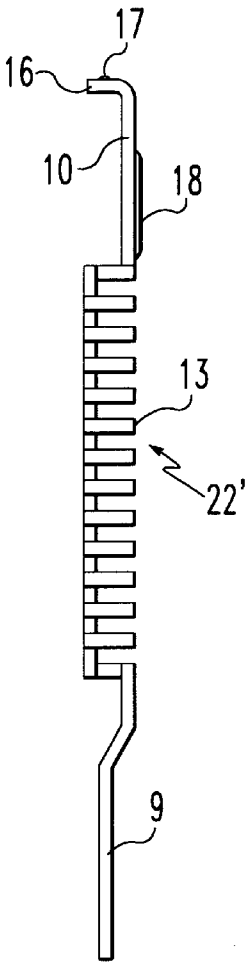
FIGS. 13*a*, 13*b*, 13*c* illustrate a method to produce a C-shaped spring contact member for a connector according to the invention.
Figure 13B:
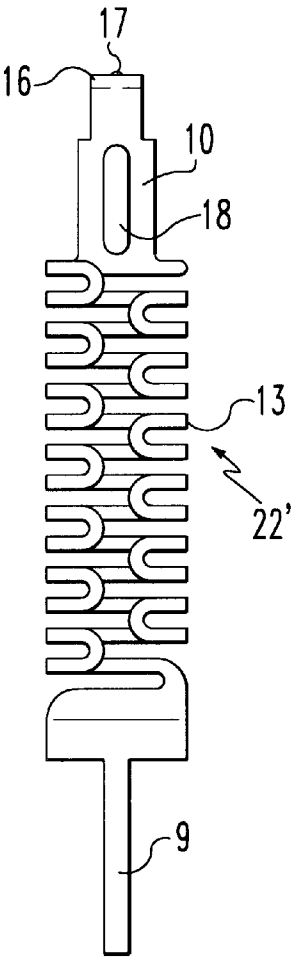
Figure 13A:
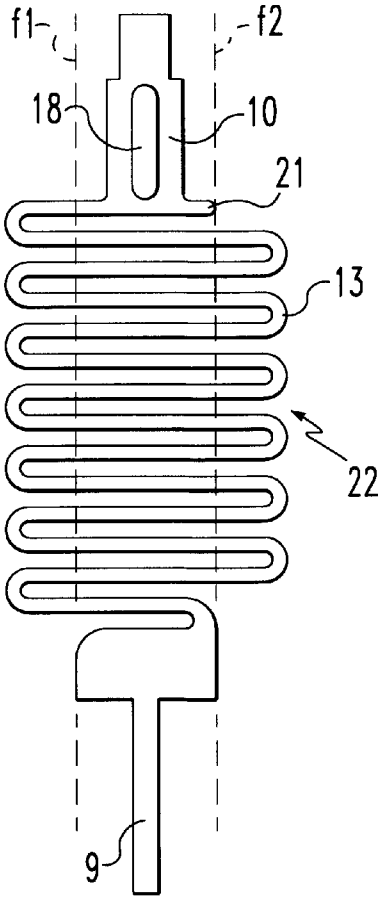

FIG. 13*a* shows an enlarged view of a spring contact member 22, preferably stamped from a thin metal sheet. FIG. 13*a* further shows two folding lines f 1, 2. In order to reduce the width of a connector block 3 each of the U-shaped base parts of the corrugated spring part 13 is folded π radians about folding lines f 1 or 2, respectively. FIG. 13*b* shows the contact member 22' after such a folding operation which clearly shows that the width of the spring contact member is reduced relative to the width of the spring contact member 22 according to FIG. 13*a*. FIG. 13*c* shows a side view of the spring contact member 22' according to FIG. 13*b*. FIG. 13*c* shows that the gain in width is at the cost of the space needed in a direction perpendicular to the width direction of FIG. 13*b*.

Like the original spring contact member 22 the spring contact members 22' according to FIGS. 13*b* and 13*c* may be provided with a bent extremity 16 provided with a dimple 17. Moreover the contact terminal 10 of the spring contact member 22' may be provided with a rib 18 like the original spring contact member 22.

Figure 14:
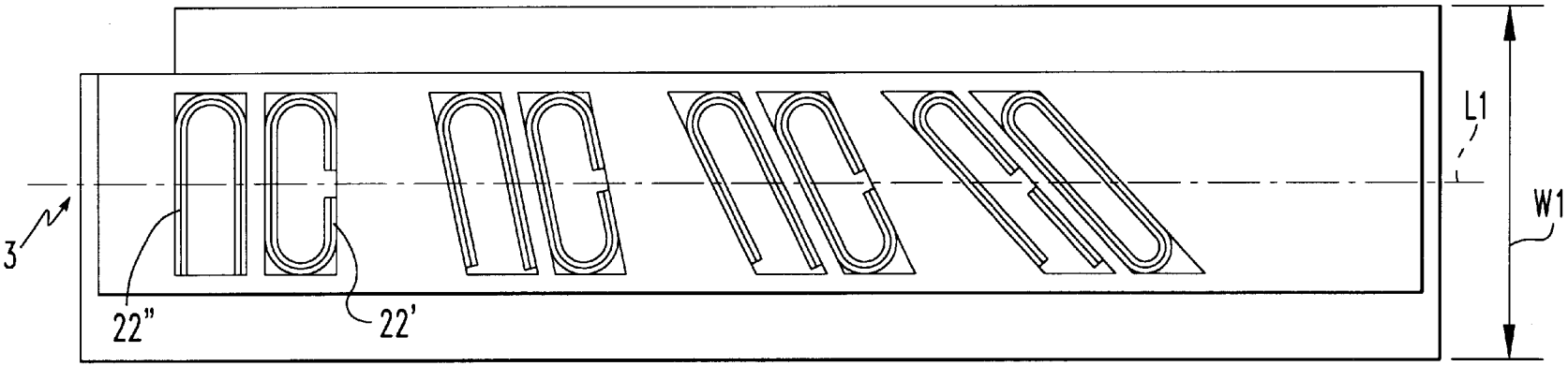
FIG. 14 shows a C-shaped spring contact member and U-shaped spring contact member within a connector block.

FIG. 14 shows several spring contact members 22' which are made in accordance with the method described above. The spring contact members 22' are shown in a top view in FIG. 14 in which they show a C-shape. The distance between the legs of the C-shaped spring contact member 22' may be varied, as required. Different distances are showing in FIG. 14. Moreover, the angle of inclination between the C-shaped spring contact members 22' and the line L1 may be varied, as required.

FIG. 14 also shows an alternative way of bending (or folding) a spring contact member 22 in order to produce an U-shaped spring contact member 22" (when seen from a top view as in FIG. 14). The distance between the legs of such U-shaped spring contact members 22" may be varied, as required. This is also shown in FIG. 14. Moreover, the angle of inclination between these U-shaped contact members 22" and the line L1 may vary in accordance with the requirements. As explained above, the larger this angle of inclination the smaller the width w1 of the connector block 3 may be.

Figure 15:
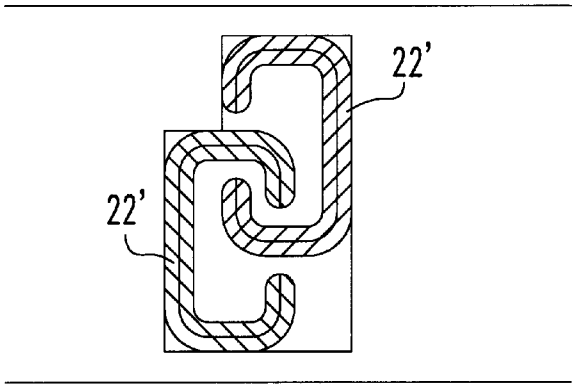
FIG. 15 shows an alternative arrangement of two C-shaped spring contact members for a connector according to the invention.

FIG. 15 shows two c-shaped spring contact members 22' produced in accordance with the method described above referring to FIGS. 13*a*, 13*b*, and 13*c*. In order to further reduce the required space for a connector block 3 the legs of two adjacent spring contact members 22' may be interlaced as shown in FIG. 15. Of course, insulating walls (not shown)between the two adjacent spring contact members 22'; may be provided in order to prevent undesired electrical contact between both spring contact members 22'.

Figure 16:
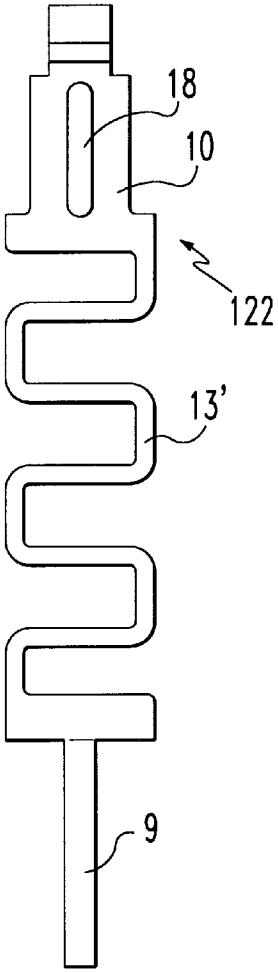
FIG. 16 shows a further embodiment of a spring contact member for a connector according to the invention.
Figure 18B:
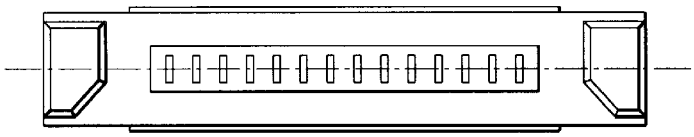
FIGS. 18*a*, 18*b*, 18*c* and 18*d* are respectively a front elevational view of another embodiment the contact, a top plan view of the contact, a cross-section through A—A in FIG. 18*a* and a detailed view of the contact.
Figure 18C:
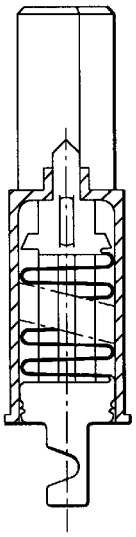
Figure 18A:
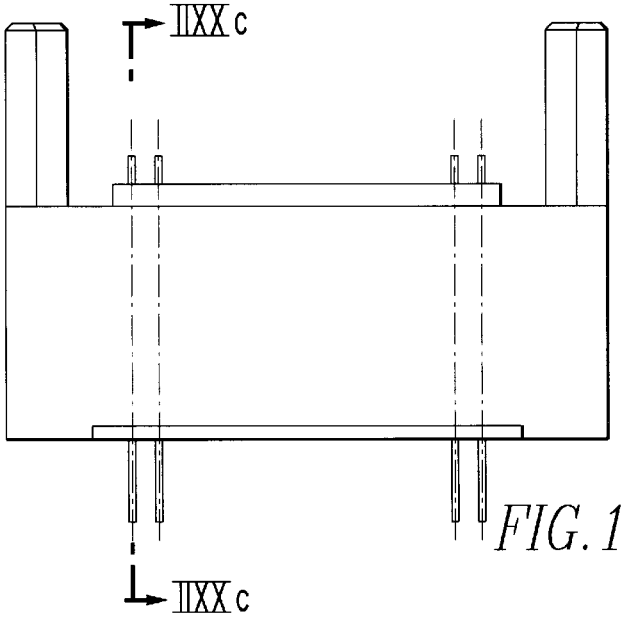
Figure 18E:
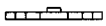
Figure 18D:
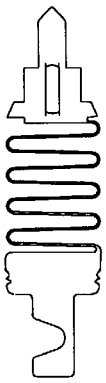
Figure 18F:
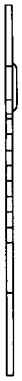
Figure 20B:
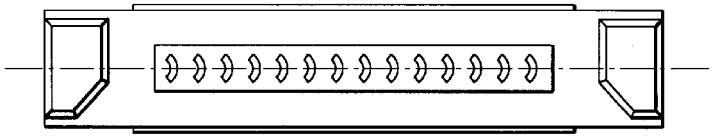
FIGS. 20*a*, 20*b*, 20*c* and 20*d* are respectively a front elevational view of another embodiment of the contact, a top plan view of the contact, a cross-section through A—A in FIG. 20*a* and a detailed view of the contact.
Figure 20C:
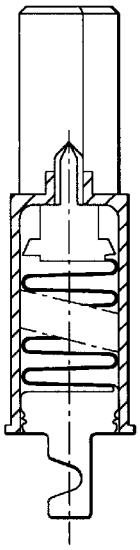
Figure 20A:
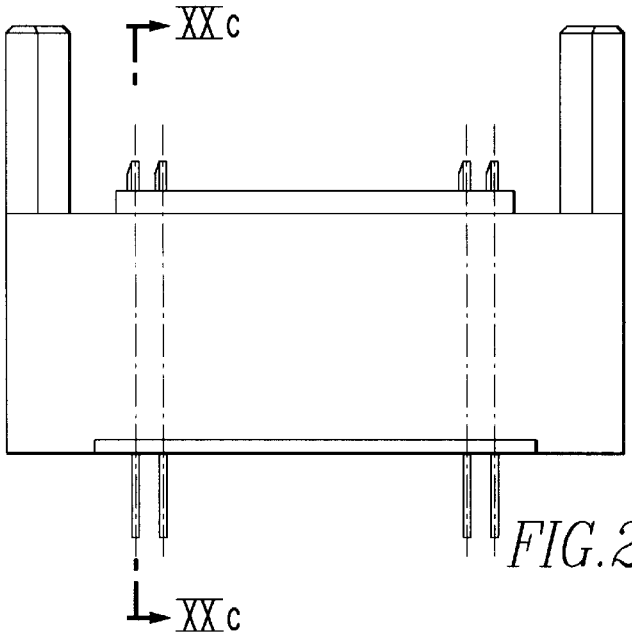
Figure 20E:
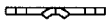
Figure 20D:
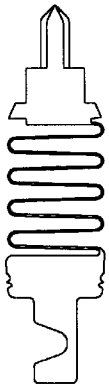
Figure 20F:
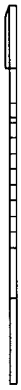
Figure 21B:
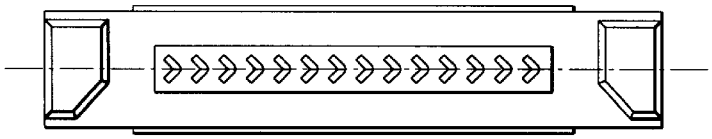
FIGS. 21*a*, 21*b*, 21*c* and 21*d* are respectively a front elevational view of another embodiment of the contact a top plan view of the contact, and a detailed view of the contact.
Figure 21C:
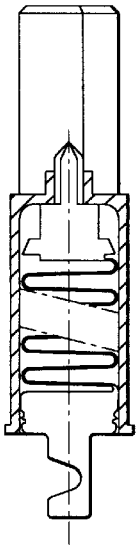
Figure 21A:
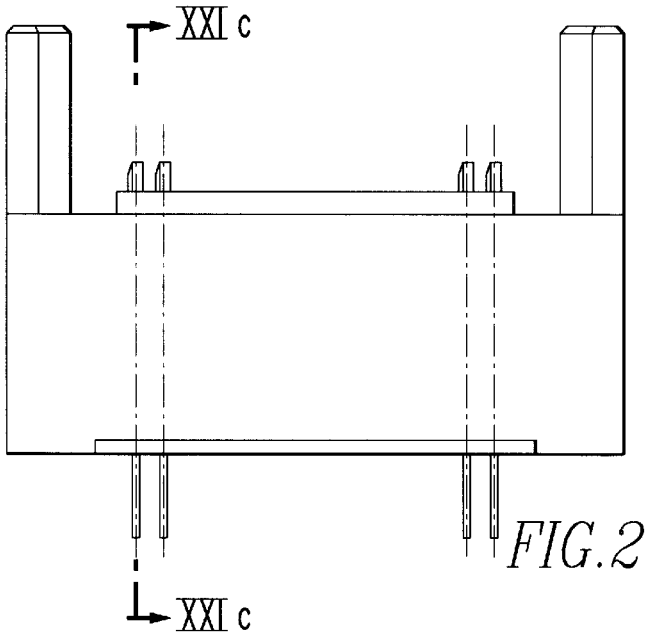
Figure 21E:
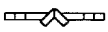
Figure 21D:
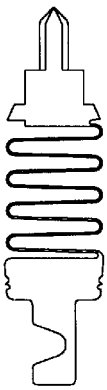
Figure 21F:
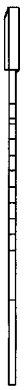

FIG. 16 shows a further embodiment of a spring contact member 122. The spring contact member 122 differs from the spring contact member 22 (e.g. FIG. 13*a*) in the ratio of the distance between adjacent legs of the corrugated spring part 13' to the width of the corrugated spring part 13' as compared to the ratio of the distance between adjacent legs of the corrugated spring part 13 to the width of the corrugated spring part 13.

Figure 17B:
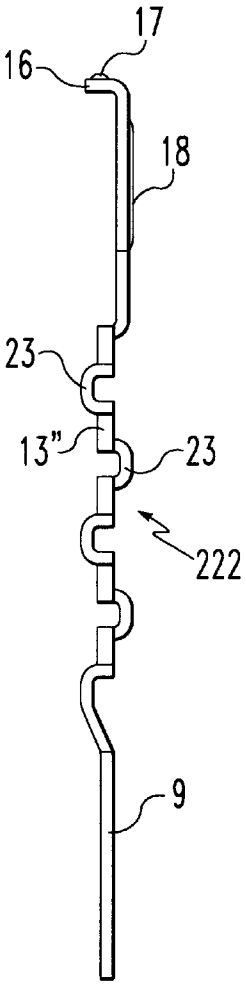
FIG. 17*a* shows a spring contact member with V-shaped corrugations for a connector according to the invention and FIG. 17*b* shows a side view of the spring connect member of FIG. 17*a*.
Figure 17A:
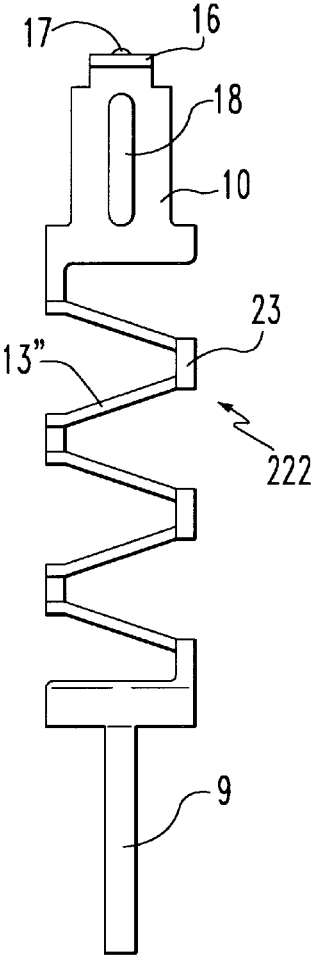

FIG. 17*a* shows that the invention is not restricted to corrugated spring contact members 22 with U-shaped. FIG. 17*a* shows a spring contact member 222 comprising a corrugated spring part 13" of which adjacent legs are arranged in a V-shape. Optionally, the base parts of these V-shapes may bend about a predetermined angle in order to reduce the width of the spring connect members 222. The bent base part is denoted by the reference sign 23. Moreover, each of the contact terminals 10 of the spring contact member 222 may be provided with a rib 18 and with a bent extremity 16, the latter in turn being provided with a dimple 17. Adjacent bent base parts 23 may be bent in opposite directions, as shown in FIG. 17*b* which shows a side view of the spring contact 222 according to FIG. 17*a*.

Three additional embodiments which are adapted for increased lateral rigidity are described as follows:

FIGS. 18*a*–18*d* show the connector as shown in separate inset 30 for only the spring terminal 32. It is to be noted that the plastic housing 34 has two plastic guide/latches 36 at the two ends 58 and 40. These plastic guide/latches are relatively large in cross-section, and also in the height protrusion above the connector mating side surface, compared to the forward protruding length of contact stubs. Consequently, such contact protrusions are sufficiently protected from accidental sideways force loading. In such a design, the contact stub portion of 50 may be straight and rectangular in cross-section without need for further re-enforcement. When the telephone is placed into the cradle, such sideways forces can occur (as a result of abuse) which justifies the large plastic latch for protection.

However, there can be an alternative design without the possibility of having such relatively large latches, or no latches. In such cases, the contact stubs need protection from lateral forces. Alternatively, there is a need to enhance the rigidity of the protruding contact stubs for such use.

It is to be noted in FIGS. 18*a*–18*d* that the bump 42 which is a portion of a semi-circular arc sheared on two sides from the lower portion of the contact stub 10, is to assist in the contact insertion from the bottom of the connector housing T-shape cavity. Consequently, this bump is fully submerged within the plastic, and cannot contribute to the sideways rigidity of the contact stub protruding above the front end of connector housing. Since this bump is sheared out of the plane from the flat base portion 10 this again does not assist in achieving desired stiffening objective.

FIGS. 19*a*–19*d* show an alternative design where the boss or rib 44 can extend over a substantial length of the contact stub 46, and even extend outside the plastic.

FIGS. 20*a*–20*d* shows yet another alternative. The semi-circular portion 48 extends substantially over the total width of the contact stub 50. Because this is a semi-circular arc, and not for instance a three quarters circle, these contacts may be stacked close to each other at small pitch.

This semi-circle may be interpreted as also a L-section as shown in FIGS. 21*a*–21*d*. However bottom of this L-section needs to be sheared from the contact stub 52, yet this transition needs to be contained within the plastic housing of the connector.

Finally, a portion with a small diameter cross-section contact stub area can be made as shown in FIGS. 21*a*–21*d*, with a perpendicularly bent contact flag (as shown in FIG. 7*c*).

The present invention is not restricted to the embodiments showing in the figures and described above. The connector blocks provided with spring contact members according to the invention are not only applicable in hand-held telephone sets. They can be applied wherever a connector block is needed having contact members with a spring action in there axial direction. Since the spring contact members themselves are made from a single piece from metal they can be easily produced. Moreover, assembling a connector block with several spring contact members according to the invention is relatively easy since the total number of pieces is reduced.

The contact pin 9 of the contact members can be substituted by contact tips or the like suitable for hold down applications. Actually, the contact pins 9 may be substituted by any type of contact terminal known to a person skilled in the art. Moreover, they may extend from a side face of block 3 instead of from the face opposite to contact terminals 10.

It is to be understood that wherever the expression "axial direction" of the contact members 22, 122, 222 is used a direction substantially coinciding with the axial direction of the contact terminals 10 is meant.

I claim:

1. Connector block (3) comprising at least one contact member (22) in at least one cavity (24), each contact member being integrally made and provided with a first contact terminal (10) for electrical contact to a contact member (6) of a mating electrical element (2), a second contact terminal (9) and a corrugated compression spring with equally spaced sinusoidal subdivisions (13) giving the contact member a resilient capacity in a predetermined axial direction and being provided with at least a substantially flat exterior surface characterized in that the first contact terminal (10) of said at least one contact member (22) is provided with a bent extremity (16) and that the first contact terminal (10) of said at least one contact terminal (22) is provided with a rib (18) parallel to the exterior surface defined by the axial direction of the first contact terminal.

2. Connector block according to claim 1 comprising each of the extremities (16) is provided with a dimple (17).

3. Connector block according to claim 1 comprising each of the extremities (16) is bent relative to the axial direction through about $\pi/2$ radians.

4. Connector block according to claim 1 comprising spring subdivisions (13) extending in a substantially flat exterior surface and is provided with an U-shaped or V-shaped interconnected part.

5. Connector block according to claim 4 further comprising the interconnected part is provided with legs and base parts interconnecting the legs, the width (x) of the legs differing from the width (y) from the base parts.

6. Connector block according to claim 4 characterized in that the connector block comprises a plurality of said contact members (22) arranged along a line (L1) and said flat exterior surfaces are inclined relative to said line (L1).

7. Connector block according to claim 1 comprising each of the spring subdivisions (13) are provided with an U-shaped or V-shaped interconnected parts provided with legs and base subdivisions interconnecting the legs, at least some of the spring parts (13) being folded in such a way that they show a substantially C-shaped or U-shaped cross section as seen in the axial direction of the contact members.

8. Connector block according to claim 1 comprising spring subdivisions (13) are provided with an U-shaped or V-shaped interconnected subdivisions provided with legs and base parts interconnecting the legs, at least one part adjacent spring subdivisions (13) being folded in such a way that they show substantially c-shaped cross sections seen in the axial direction of the contact members, the c-shaped cross sections being interlaced.

9. Connector block according to claim 1 comprising a plurality of cavities and each of the cavities (24) are provided with a by-pass strip (20) for reducing the electrical resistance between the first terminal (10) and the second terminal (9) of each of the contact members (22).

10. Connector block according to claim 9 further comprising that each of the by-pass strips (20) comprise a metal layer on the inside surface of the respective cavity (24).

11. Connector block according to claim 9 further comprising the spring subdivision (13) is provided with a part (21) close to the first terminal (10), said part (21) is resiliently forced against the by-pass strip (20).

* * * * *